US006808257B2

(12) United States Patent
Yamazaki et al.

(10) Patent No.: US 6,808,257 B2
(45) Date of Patent: Oct. 26, 2004

(54) RECORDING METHOD

(75) Inventors: Yasunori Yamazaki, Suwa (JP); Shoji Takei, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/630,183

(22) Filed: Jul. 30, 2003

(65) Prior Publication Data

US 2004/0021756 A1 Feb. 5, 2004

Related U.S. Application Data

(63) Continuation of application No. 09/899,012, filed on Jul. 3, 2001, now Pat. No. 6,619,793.

(30) Foreign Application Priority Data

Jul. 4, 2000 (JP) ..... 2000-202494

(51) Int. Cl.[7] ..... B41J 2/01
(52) U.S. Cl. ..... 347/100; 347/105
(58) Field of Search ..... 347/100, 102, 347/105

(56) References Cited

U.S. PATENT DOCUMENTS 4,597,794 A * 7/1986 Ohta et al. ..... 347/100
4,780,356 A * 10/1988 Otouma et al. ..... 428/32.37
5,130,726 A 7/1992 Fukushima et al. ..... 347/102
5,145,518 A * 9/1992 Winnik et al. ..... 523/161
5,771,054 A * 6/1998 Dudek et al. ..... 347/102
5,786,835 A 7/1998 Ikeda et al. ..... 347/106
6,068,368 A 5/2000 Lum et al. ..... 347/55

FOREIGN PATENT DOCUMENTS

| | | |
|---|---|---|
| CN | TW338021 | 8/1998 |
| EP | 0 443 872 A2 | 8/1991 |
| JP | 55-49290 | 4/1980 |
| JP | 61-163296 | 7/1986 |
| JP | 3-147883 | 6/1991 |
| JP | TW260653 | 10/1995 |
| JP | 08-156394 | 6/1996 |
| JP | 09-314986 | 12/1997 |
| JP | 11-277724 | 10/1999 |
| JP | 11-277725 | 10/1999 |

* cited by examiner

*Primary Examiner*—Lamson Nguyen
*Assistant Examiner*—Blaise Mouttet

(57) ABSTRACT

A soft alumite is produced by forming an oxide film on the surface of an aluminum substrate. Printing is performed on a porous layer formed on the surface of the soft alumite while heating the soft alumite. Alternatively, printing is performed with a dye-based ink on a porous layer formed on the surface of the soft alumite.

1 Claim, 5 Drawing Sheets

RECORDING METHOD

This application is a divisional of U.S. patent application Ser. No. 09/899,012, filed Jul. 3, 2001, now U.S. Pat. No. 6,619,793, which is incorporated herein in its entirety by reference.

BACKGROUND OF THE INVENTION

1. Field of the Invention

The present invention relates to a recording method for performing printing on the surface of a material to be printed made of a nonabsorbent material which does not absorb ink, such as aluminum.

2. Description of the Related Art

A conventional recording method for drawing on an aluminum surface is disclosed in, for example, Japanese Unexamined Patent Application Publication No. 11-326548. In this publication, the dial of a watch is made of aluminum and a receiving layer is formed on the surface thereof. A coloring material (pigment) is applied onto the receiving layer so as to print characters and the like thereon.

In the above recording method, pigment is used as the coloring material. Since pigment particles are large, they are not thoroughly received by the receiving layer and are not fixed easily thereon.

Furthermore, in the above recording method, ink droplets of a plurality of colors are appropriately superimposed on the receiving layer so as to produce a specific color. When the ink droplets are superimposed, they spread (blur) on the aluminum surface, and therefore, a clear image cannot be obtained.

FIG. 8 is an explanatory view showing a case in which a drawing function using a printer head is performed on a substance made of a nonabsorbent material, which does not absorb ink droplets. When an ink droplet 11*a* is ejected from a first nozzle 11 of a printer head 10 and an ink droplet 12*a* is then ejected from a second nozzle 12 to the same position, both ink droplets 11*a* and 12*a* are mixed and spread (blur) with the passage of time, as shown in section C.

OBJECTS OF THE INVENTION

The present invention has been made to overcome the above problems, and an object of the invention is to provide a recording method which reduces blurring and makes it easier to fix ink droplets in position on a printing surface.

SUMMARY OF THE INVENTION (1) In a recording method according to an aspect of the present invention, printing is performed on the surface of a substance made of a nonabsorbent material that does not typically absorb an ink droplet. Preferably, the substance is heated while being printed upon. Since printing is performed on the surface while heating the surface, moisture contained in the ink droplet is evaporated and adsorption of the ink droplet onto the nonabsorbent material is facilitated, thereby reducing the printing time. For this reason, the ink droplet is restrained from spreading, blurring is prevented, and a clear image can therefore be obtained.

(2) In a recording method according to another aspect of the present invention, the nonabsorbent material in the above enumerated paragraph (1) is a soft alumite. Since printing is performed while heating the soft alumite in this invention, not only drying of the ink droplet but also adsorption of the ink droplet into a porous layer formed on the surface of the soft alumite is speeded up, and the ink droplet is fixed in position in a short time. For this reason, the ink droplet is restrained from spreading and blurring is prevented.

(3) In a recording method according to a further aspect of the present invention, a soft alumite is produced by forming an oxide film on an aluminum surface, and printing is performed on the surface of the soft alumite while heating the soft alumite. Since printing is performed on a porous layer formed on the surface of the soft alumite in this invention, an ink droplet can easily enter minute holes of the porous layer and ink blurring can be prevented. Furthermore, since printing is performed while heating the soft alumite, in a manner similar to the above, adsorption of the ink droplet to the porous layer is speeded up, and the ink droplet is fixed in a short time. For this reason, the ink droplet is restrained from spreading and blurring is prevented. In particular, since the size and depth of the holes of the porous layer formed in the soft alumite are optimized for this application, the above advantages are pronounced.

(4) In a recording method according to a further aspect of the present invention, recited in enumerated paragraph (3), printing is performed with a dye-based ink. Since particles of the dye-based ink are small, they easily enter the minute holes of the porous layer. Furthermore, since the dye-based ink is subjected to ion separation, they are fixed in the holes of the porous layer by molecular adsorption or ion binding. For this reason, the ink droplet is fixed firmly, and chemical resistance is increased. Since absorption by molecular adsorption or ion binding is speeded up by the heat treatment and fixing is completed in a short time, the ink droplet is restrained from spreading. This also prevents blurring.

(5) In a recording method according to a further aspect of the present invention, a porous layer is formed on the surface of a nonabsorbent material which does not absorb an ink droplet, and printing is performed thereon with a dye-based ink. Since particles of the dye-based ink are small, they easily enter minute holes of the porous layer, and this prevents blurring. Furthermore, since the ink droplet is adsorbed by molecular adsorption or ion binding and is fixed firmly, chemical resistance is increased.

(6) In a recording method according to a further aspect of the present invention, a soft alumite is produced by forming an oxide film on an aluminum surface, and printing is performed on the soft alumite with a dye-based ink. Since printing is performed with the dye-based ink on a porous layer formed on the surface of the soft alumite in this invention, particles of the dye -based ink easily enter minute holes of the porous layer, and blurring can therefore be prevented. Since the ink droplet is adsorbed by molecular adsorption or ion binding and is fixed firmly, chemical resistance is increased.

(7) In a recording method according to a further aspect of the present invention, printing is performed on a soft alumite with a dye-based ink. Since the soft alumite is used, blurring is prevented and chemical resistance is increased, as described above.

(8) In a recording method according to a further aspect of the present invention as recited in the above enumerated paragraphs (1) to (7), a sealing treatment is performed after printing. Since the ink layer is coated by sealing treatment, wear resistance is increased.

(9) In a recording method according to a further aspect of the present invention as recited in enumerated paragraphs (1) to (4), and (8), the heating temperature is preferably within the range of 30° C. to 80° C. In this invention, the lower limit temperature, at which the advantages are provided with respect to room temperature (20° C. to 25° C.), is set at 30° C., and the upper limit temperature is set at 80° C. in consideration of the decomposition temperature of the dye-based ink.

(10) In a recording method according to a further aspect of the present invention as recited in the above enumerated paragraphs (9), the heating temperature is preferably within the range of 30° C. to 60° C. The upper limit of the temperature is set to 60° C. in consideration of the decomposition temperatures of some dye-based inks that are low.

(11) In a recording method according to a further aspect of the present invention in accordance with the above recording method (10), the heating temperature is preferably set to a range of 40° C. to 50° C. In this embodiment, the lower limit temperature, at which pronounced advantages are provided with respect to room temperature (20° C. to 25° C.), is set at 40° C., and the upper limit temperature is set at 50° C. in consideration of variations in decomposition temperatures of dye-based inks.

(12) In a recording method according to a further aspect of the present invention as recited in the above enumerated paragraphs (1) to (11), the printing operation is a color printing operation. Color printing is accomplished by superimposing ink droplets, which would typically lead to blurring, this invention, however, blurring can be prevented by the heat treatment. Moisture contained in the ink droplets is evaporated by heat treatment, and adsorption of the ink droplets into the nonabsorbent material is speeded up and is completed in a short time. This can prevent blurring.

(13) In a recording method according to a further aspect of the present invention as recited in the above enumerated paragraphs (1) to (12), the printing operation is performed by an ink-jet printer. In this invention, printing is performed on the nonabsorbent material by an ink-jet printer, which is a widely used printing apparatus.

(14) In a recording method according to a further aspect of the present invention as recited in enumerated paragraphs (1) to (4) and (8) to (13), the heating operation includes a partial heating operation with a laser. In this invention, the printing portion is subjected to partial heating with a laser. Such local heating leads to energy saving.

(15) In a recording method according to a further aspect of the present invention as recited in enumerated paragraphs (1) to (4) and (8) to (13), the heating operation includes a partial heating operation with infrared rays. In this invention, the printing portion is subjected to partial heating with infrared rays. Such local heating leads to energy saving.

(16) In a recording method according to a further aspect of the present invention as recited in above paragraphs (1) to (4) and (8) to (13), the heating operation is performed with a stroboscope. In this invention, the printing portion is instantaneously heated with a stroboscope. Such instantaneous heating leads to energy saving.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

First Embodiment

FIG. 1 is an explanatory view showing a recording method according to the present invention.

An aluminum oxide film 21 is formed on a surface of an aluminum substrate 20 (FIGS. 1(*a*) and 1(*b*)). The aluminum oxide film 21 is produced by, for example, anodizing the substrate 20 in a sulfate solution. The aluminum oxide film 21 includes a porous alumina layer, $Al_2O_3$ which functions as a receiving layer. Such a combination of the aluminum substrate 20 and the aluminum oxide film 21 is referred to as an "alumite" 22.

Figure 1A:
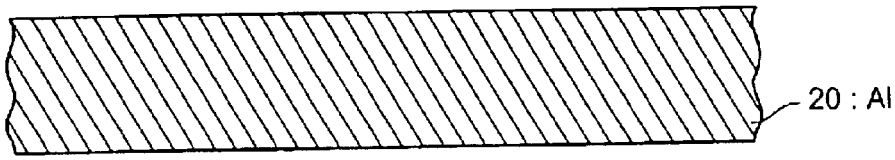
FIG. 1 is an explanatory view showing a recording method according to the present invention.
Figure 1B:
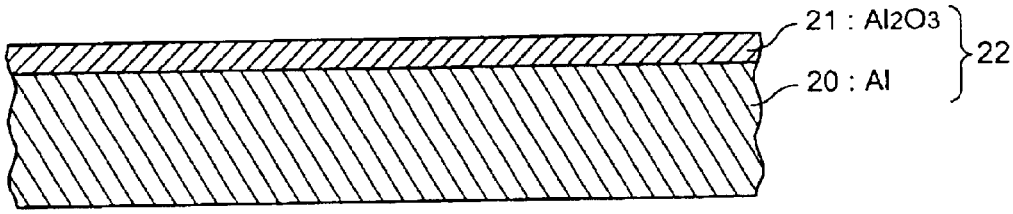
Figure 1C:
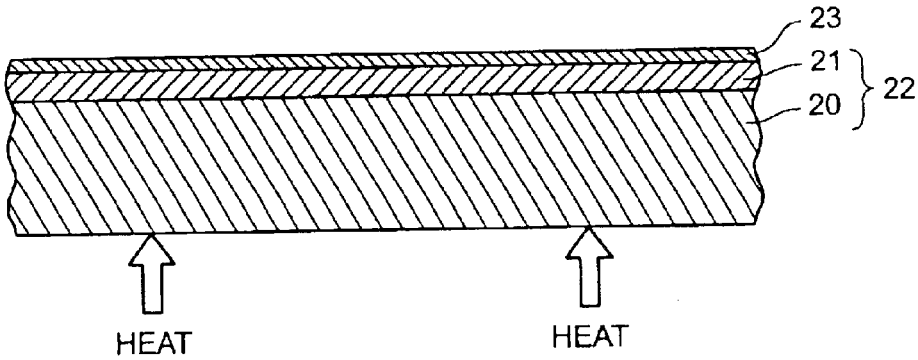
Figure 1D:
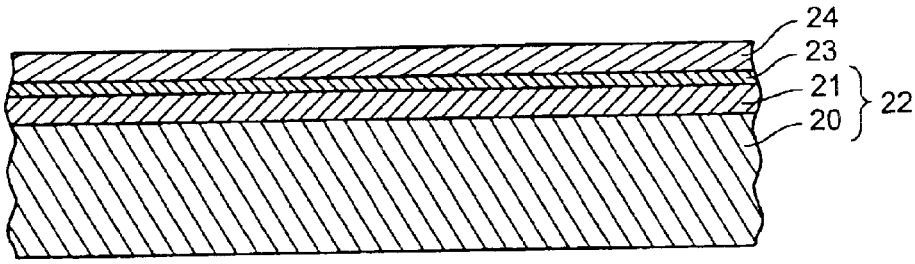
Figure 2:
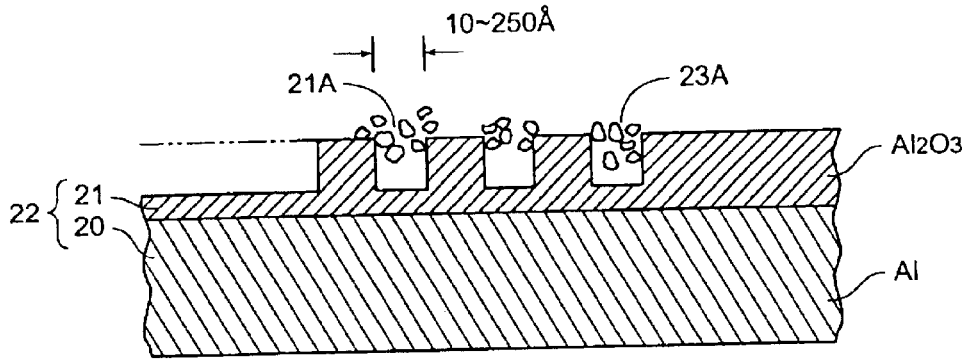
FIG. 2 is a detailed view of an aluminum oxide film shown in FIG. 1.

FIG. 2 is a detailed view of the aluminum oxide film 21. Each hole 21*a* of the porous alumina layer formed in the aluminum oxide film 21 has a diameter of approximately 10 Å to 250 Å. In the present invention, soft alumite 22 with a structure as described above is preferred because hard alumite complicates the formation of proper holes. That is, it is more difficult to form minute holes 21*a* of appropriate width and depth, as shown in FIG. 2, using hard alumite.

Subsequently, an ink layer 23 is formed (FIG. 1(*c*)) by ejecting ink droplets 23*a* from an ink-jet head so as to perform a drawing function (see FIG. 2). The ink is preferably dye-based. Since particles of the dye-based ink have a size of approximately 8 Å to 30 Å (up to 50 Å) and are subjected to ion separation, they easily enter the holes 21*a* and are ion-adsorbed or molecular-adsorbed. For this reason, the ink droplets 23*a* are easily fixed to the aluminum oxide film 21, and this improves chemical resistance. In contrast, particles of pigment-based ink typically have a size of 300 Å or more, they do not easily enter the holes 21*a*. Moreover, since they are not subject to ion separation, the particles of a pigment-based ink are not easily adsorbed by ion adsorption or the like, and are thus difficult to fix to the aluminum oxide film 21 and have a lower chemical resistance.

During a drawing operation in accord with the present invention, a heat treatment is preferably carried out. The heat treatment serves two functions:

(a) it promotes ionic binding or molecular adsorption; and (b) it drys the ejected ink droplets. These two functions will be described in greater detail later.

Next, sealing treatment is carried out (FIG. 1(*d*)). Sealing treatment is performed by producing a nickel film 24 by soaking the above printed material in a nickel sulfate solution. The sealing treatment is not essential, and the holes may be naturally sealed by being left in air.

The above functions (a) and (b) of the heat treatment will now be described.

(a) Speeding up of Ionic Binding or Molecular Adsorption

The ink droplets 23*a* are not held in the holes 21*a* of the aluminum oxide film 21 in a relationship like "water being poured in a bucket", but are held by "ionic binding or molecular adsorption" due to the increase in surface area of the holes 21*a* of the aluminum oxide film 21, that is, of pits and projections. The following Arrhenius equation is well known as a formula relating to this reaction:

$$k=A\exp(-Ea/RT)$$

wherein k represents the rate constant, T represents the absolute temperature, R represents the gas constant, and A and Ea represent constants inherent in the reaction, where A represents a frequency factor and Ea represents activation energy.

Figure 3:
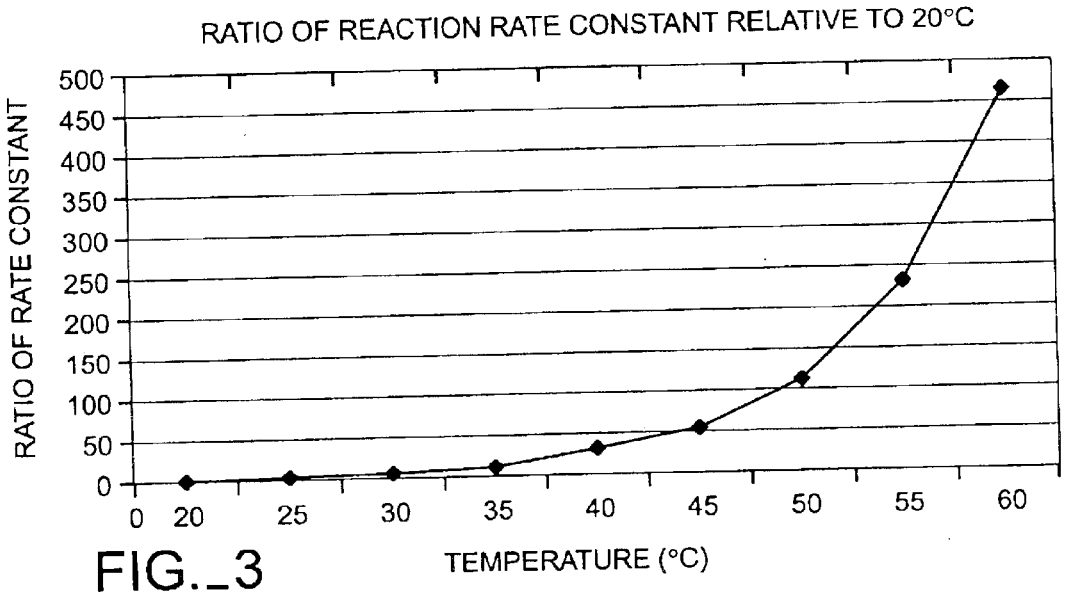
FIG. 3 is a characteristic view showing the ratio of the reaction rate constant relative to 20° C.

FIG. 3 is a characteristic view showing the ratio of the reaction rate constant relative to 20° C. Ea/R of inks is approximately 15000. Herein, the ratio k40/k20 of a reaction rate k equal to 20 at 20° C. and a reaction rate k at 40° C. is approximately equal to 26. This shows that the reaction rate k40 is twenty-six times as high as the reaction rate k20.

(b) Drying of Ejected Ink Droplets

Figure 8:
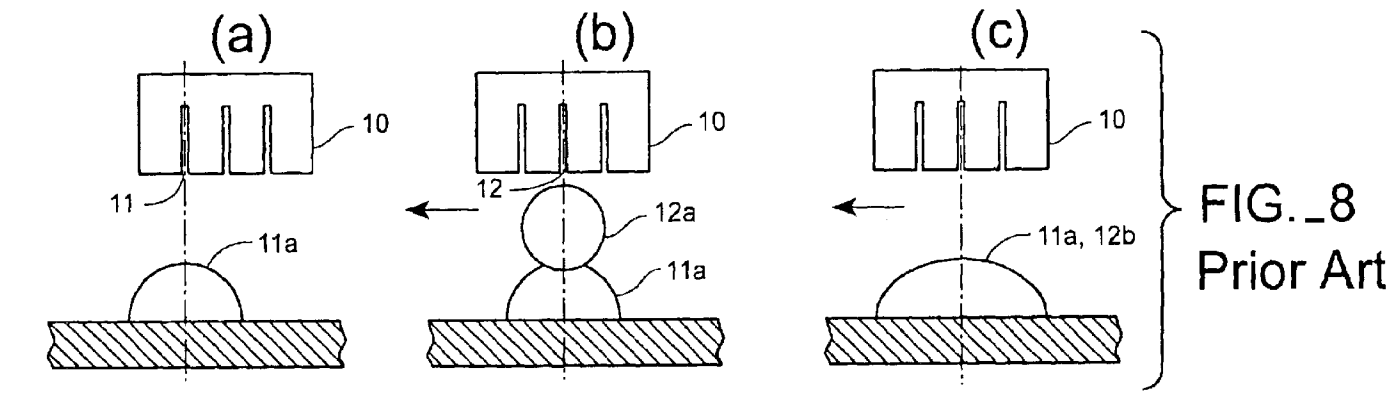
FIG. 8 Prior Art
FIG. 8 is an explanatory view of a conventional recording method.

For example, the ink-jet head is designed on the assumption that an ink droplet is fixed on a medium (a material on which drawing is performed) so as to have diameters ranging from 40 μm to 50 μm when drawing is performed at 720 dpi and at the normal dot size (19 pl). In a case in which the printed material is paper, while the ink droplet instantaneously spreads in the radial direction due to the impact of landing, it does not spread further because it permeates the paper. In contrast, an ink droplet permeates the minute surface holes of the alumite to some extent, and cannot be entirely absorbed. Since wettability of the ink with respect to the alumite is relatively low (50 to 60 dyne/cm), one ink droplet is held in a semispherical shape of a proper size and having a diameter of approximately 45 μm. When an ink droplet of another color is superimposed thereon for color mixture, however, this shape cannot be maintained, the color balance of the entire image is disturbed, and the image becomes blurred (see FIG. 8).

In this case, such image degradation can be prevented by removing excess moisture from the ink before ejecting the next ink droplet. That is, the moisture is removed by permeation when paper is used, and by evaporation by heat in this embodiment.

Figure 4:
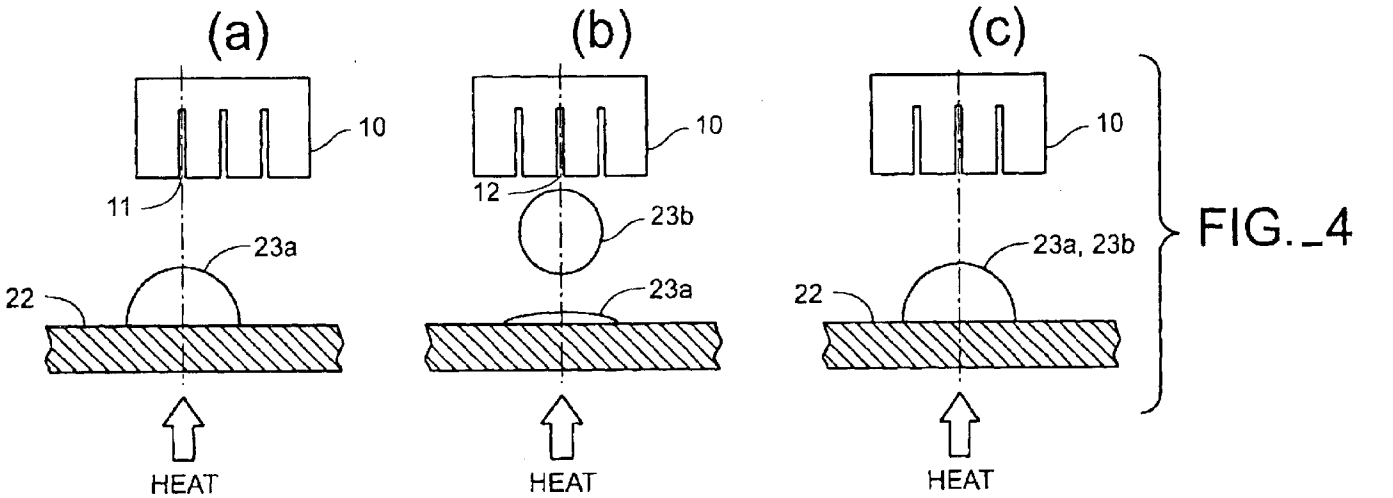
FIG. 4 is an explanatory view showing a heating state.

FIG. 4 is an explanatory view showing a heating state. When an ink droplet 23*a* is ejected from a nozzle 11 of a printer head 10, moisture is evaporated from the ink droplet 23*a*, and, only a solid material of, for example, 20 w % or less remains, that is, the ink droplet 23*a* remains without spreading. When an ink droplet 23*b* is then ejected from a nozzle 12 to the same portion, it is placed on the preceding ink droplet 23*a* and does not spread (does not become blurred), as was the case in FIG. 8. Since drying is performed at the next instant, printing is performed speedily.

The conditions of the above heat treatment are set at the following values for a general type of printer:

dpi: 720 dpi ink jet frequency: 20 kHz carriage moving speed: 700 mm/s color nozzle pitch: 3 mm amount of ink per droplet: 19 pl In this embodiment, ink must be evaporated within 3 mm/700 mm/s, that is, within 4 ms. Since the latent heat of water, which is the principal component of the ink, is approximately 80 cal, a required quantity of heat is $19\times10^{-9}\times80\approx2\times10^{-6}$ cal. Therefore, it is only necessary to apply, to each nozzle, $2\times10^{-6}/4\times10^{-3}=5\times10^{-4}$ cal/sec of heat. While the heat quantity is quite small, it is confirmed by experiment that it is actually necessary to apply heat in a quantity much larger than the above heat quantity because of the coefficient of thermal conductivity and the like. It is confirmed by experiment that the desired function can be achieved by placing an A4-size aluminum plate having a thickness of 3 mm, which serves as a material to be printed, on an A4-size aluminum plate having a thickness of 5 mm and heated to 40° C., and performing printing thereon.

While it is preferable that the heating temperature be higher, according to the characteristic shown in FIG. 3, the heating temperature is set at 30° C. to 80° C. or 30° C. to 60° C., or more preferably, at 40° C. to 50° C., in consideration of the decomposition temperature of the pigment-based ink.

In the present invention, the above-described heating method, in which a material to be printed is placed on a heating plate (aluminum plate), may be replaced with, for example, partial heating with a laser, partial heating with infrared rays, heating with light and warm air, or heating with a stroboscope (including a strobe light).

Figure 5:
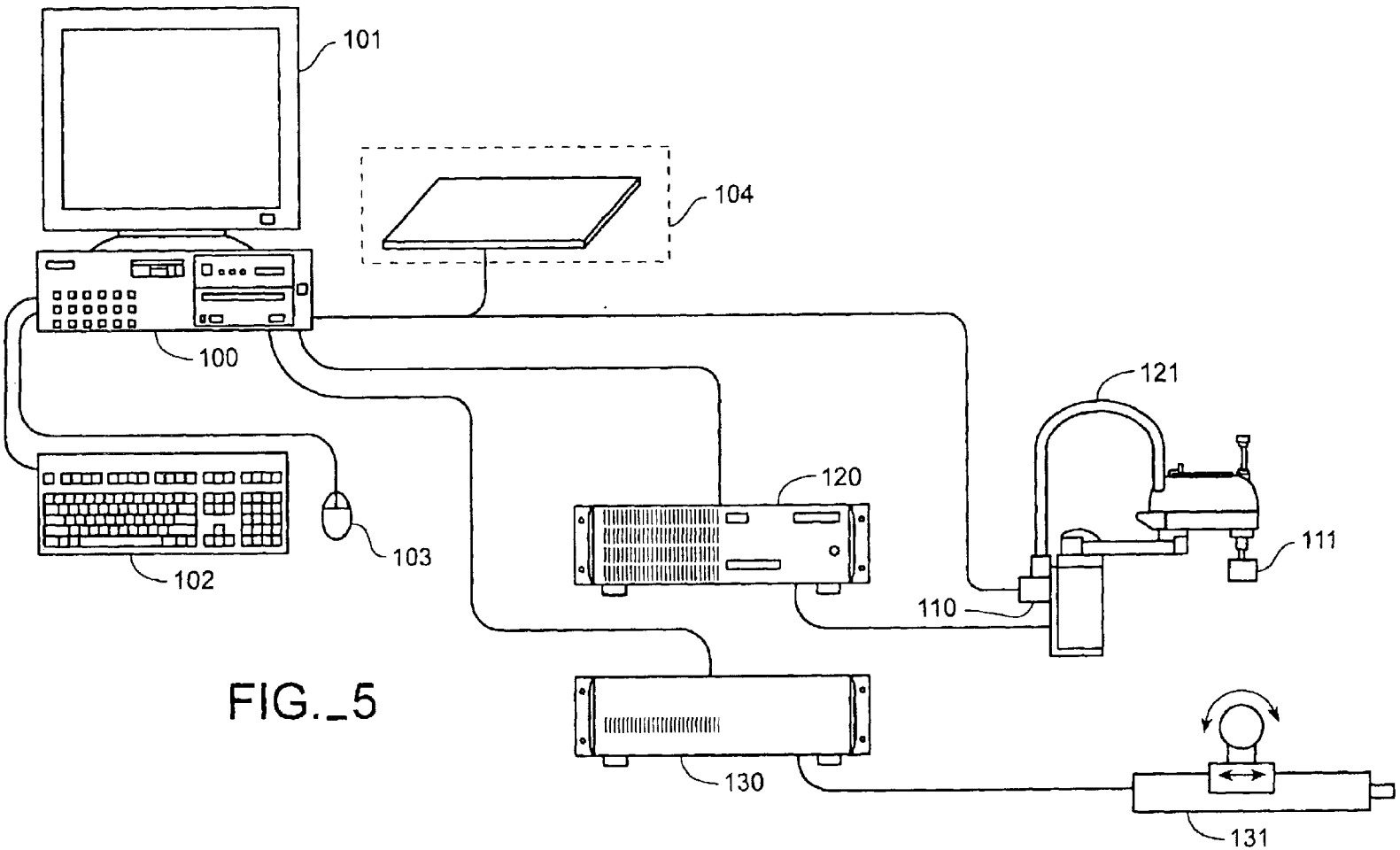
FIG. 5 is a view showing the configuration of an exemplary recording apparatus for performing printing in accordance with FIG. 1(*c*)

FIG. 5 is a view showing the configuration of the principal part of a preferred recording apparatus for performing printing as shown in FIG. 1(*c*). A robot system controller (hereinafter referred to as a "controller") 100 is structured by a factory automation, FA, personal computer and is connected to a display 101, a keyboard 102, and a mouse 103.

The controller 100 controls a printing substrate 104, a SCARA (Selective Compliance Assembly Robot Arm) robot driver 120, and a multi-axis pulse-motor driver 130, which will be described later. The controller 100 also converts bit map data of each color into data in accordance with the nozzle arrangement, and stores the converted data as print data in a file (hereinafter referred to as an "N file"). The display 101 provides a graphics user interface, GUI, for the controller (FA personal computer) 100, and constitutes a man-to-machine interface, which performs the following operations, together with the keyboard 102 and the mouse 103.

(1) Directing that print data (drawing data) be converted from bit map data and be stored in the N file (it should be noted that storage is only directed when an N file is created by another personal computer).

(2) Creating designation data as to which of a plurality of stored data is to be printed and where the data is to be printed.

(3) Creating an automatic robot operation program using a robot programming language based on the above designation data.

(4) Operating the printer, for example, starting and stopping printing.

The printing substrate 104 is inserted as an optional substrate in the controller (FA personal computer) 100. The printing substrate 104 sequentially fetches data for one line from the N file stored in the controller 100, and sends the data to a head driver 110 in response to the operation of a SCARA robot 121 (relative movement between the printer head and the material to be printed).

The head driver 110 actuates piezoelectric devices corresponding to the ink nozzles in the printer head 111 based on signals sent from the printing substrate 104 so that ink droplets are ejected for printing.

The SCARA robot driver (four axis) 120 drives the SCARA robot 121 in a four-axis manner based on signals from the controller 100. The head driver 110 and the printer head 111 are attached to the SCARA robot 121. In particular, the printer head 111 is mounted at the leading end of an arm of the SCARA robot 121, and the three-dimensional position thereof is controlled arbitrarily so that the distance between the printer head 111 and the printing position is controlled to be constant. The multi-axis pulse-motor driver 130 controls a robot with linear and revolution axes 131 according to signals from the controller 100.

Figure 6:
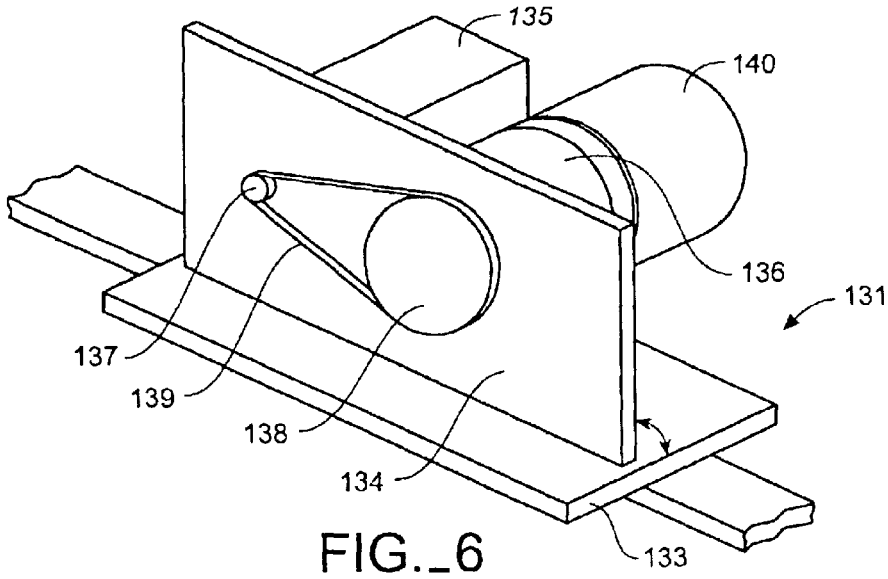
FIG. 6 is an explanatory view of a robot with linear and revolution axes.

FIG. 6 is an explanatory view showing an example of a structure of the robot with linear and revolution axes 131. In FIG. 6, a mounting plate 134 is mounted on a substrate 133 so as to stand substantially perpendicularly thereto. One side of the mounting plate 134 is provided with a pulse motor 135 for rotational driving and a mounting jig 136 for mounting a solid material to be printed. In this embodiment, description will be given of a case in which printing is performed on, for example, an aluminum can 140 serving as the solid material to be printed, which has been subjected to the treatment shown in FIG. 1(*b*). The mounting jig 136 has a cylindrical outer shape which conforms to the inner surface of the aluminum can 140.

The other side of the mounting plate 134 is provided with a toothed pulley 137 connected to the pulse motor 135, and a toothed pulley 138 connected to the mounting jig 136. These toothed pulleys 137 and 138 are linked by a timing belt 139. The rotational force of the pulse motor 135 is transmitted to the mounting jig 136 via the toothed pulley 137, the timing belt 139, and the toothed pulley 138, thereby rotating the mounting jig 136. The mounting plate 134 is mounted on the substrate 133 so that the mounting angle θ with respect to the substrate 133 can be adjust properly. The substrate 133 is supported so as to be linearly moved by driving another pulse motor (not shown). The mounting jig 136 is driven rotationally and linearly in this way.

Figure 7:
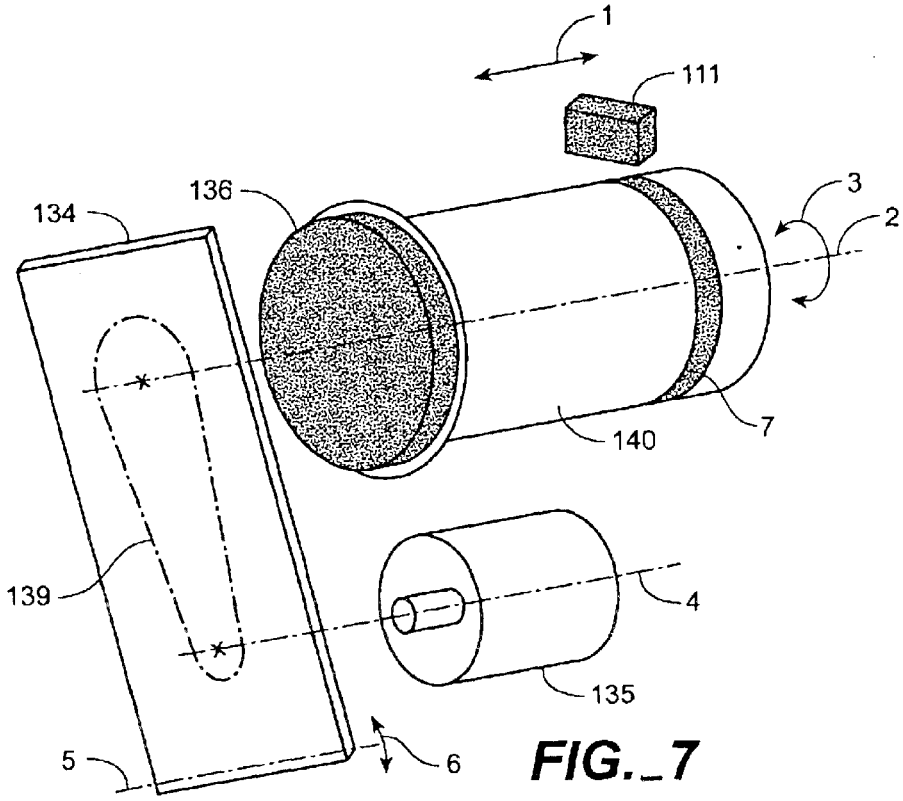
FIG. 7 is an explanatory view conceptually showing the recording apparatus shown in FIG. 5 in order to explain operation thereof.

FIG. 7 is an explanatory view conceptually showing the recording apparatus shown in FIG. 5 in order to explain the operation thereof. A description will be given of the mechanism of the apparatus with particular emphasis on the printer head 111 and the mounting jig 136. The printer head 111 is mounted at the leading end of the arm of the SCARA robot 121 and can be moved in a horizontal direction 1 by a position feedback type servo motor (not shown) disposed in the SCARA robot 121. The aluminum can 140 is mounted by being fitted on the mounting jig 136. The mounting jig 136 is driven by the pulse motor 135 so as to rotate on a center line 2 in a direction of arrow 3. The rotation center line 2 of the mounting jig 136 and a rotation center line 4 of the pulse motor 135 are parallel to each other, and are perpendicular to a bearing mechanism (not shown) of the mounting jig 136 and the mounting surface of the mounting plate 135. The mounting plate 134 can be fixed so as to pivot on a pivot center line 5 perpendicular to the center line 4 in a direction of arrow 6, as described above (see θ in FIG. 6). While the mounting jig 136 is cylindrical in the example shown in FIG. 7, when it is, for example, conical, the mounting plate 134 is fixed at an angle so that the horizontal lower surface of the printer head 111 serving as an ink ejecting surface and the printing tangent plane of the (tapered) aluminum can 140 are parallel to each other.

In the mechanism shown in FIG. 7, the pulse motor 135 is continuously rotated, and the mounting jig 136 is also rotated. When the aluminum can 140 is thereby rotated, the printer head 111 is moved to the left or right as shown by arrow 1, and ink droplets are ejected in an appropriate timing with the rotation and the movement. By doing this, printing can be performed in a print area 7 on the surface of the aluminum can 140 serving as the solid material to be printed. Although not illustrated, the printed portion is heated by partial heating with a laser, partial heating with infrared rays, heating with light and warm air, or heating with a stroboscope (including a strobe light), thereby speeding up ion binding or molecular adsorption of the ink droplets.

While printing is performed on the surface of a soft alumite, which does not absorb ink droplets, while heating the soft alumite in the description of the above embodiment, it is not always necessary to form a porous layer when performing heat treatment. Furthermore, in the present invention, heat treatment may be omitted, and printing may be performed with a dye-based ink on a porous layer (receiving layer) formed on the surface of a nonabsorbent material.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A recording method for printing with an ink-jet printer onto a surface of a nonabsorbent printing material that does not absorb ink droplets, said method comprising:

assuring that said nonabsorbent printing material has a porous receiving layer;

applying a heating treatment to said printing material during a printing operation onto said porous receiving layer;

wherein said porous receiving layer is made to have a plurality of holes, each of said holes having a diameter in the range of 10 angstroms to 250 angstroms;

wherein said printing operation is performed with a dye-based ink having a plurality of particles; and wherein the particles of said dye-based ink have a size in the range of 8 angstroms to 50 angstroms and are subjected to ion separation.

* * * * *